US009039090B2

(12) United States Patent
Pritchard

(10) Patent No.: US 9,039,090 B2
(45) Date of Patent: May 26, 2015

(54) HEIGHT ADJUSTMENT MECHANISM SUITABLE FOR A FOOTRING

(71) Applicant: LEGGETT & PLATT CANADA CO., Waterloo (CA)

(72) Inventor: Christopher Pritchard, Waterloo (CA)

(73) Assignee: Leggett & Platt Canada Co., Waterloo (CA)

( * ) Notice: Subject to any disclaimer, the term of this patent is extended or adjusted under 35 U.S.C. 154(b) by 0 days.

(21) Appl. No.: 13/803,485

(22) Filed: Mar. 14, 2013

(65) Prior Publication Data

US 2014/0265512 A1 Sep. 18, 2014

(51) Int. Cl.
*A47C 7/50* (2006.01)

(52) U.S. Cl.
CPC ..... *A47C 7/506* (2013.01)

(58) Field of Classification Search
CPC ..... A47C 7/506; A47C 7/004; A47C 9/02; A47C 3/20; A47C 3/24; A47C 3/28
USPC ..... 108/147.19; 297/423.38, 423.12; 248/188.2, 188.5, 161, 230.2, 231.31, 248/410, 411
See application file for complete search history.

(56) References Cited

U.S. PATENT DOCUMENTS

| | | | | |
|---|---|---|---|---|
| 519,311 | A | 5/1894 | Andrew et al. | |
| 689,855 | A | 12/1901 | Copeland | |
| 1,970,624 | A | 9/1932 | Recker | |
| 2,532,168 | A | 6/1948 | Jakoubek | |
| 3,458,234 | A | 7/1969 | Bates | |
| 4,253,632 | A | 3/1981 | Doerner | |
| 4,277,197 | A | 7/1981 | Bingham | |
| 4,580,804 | A * | 4/1986 | Weber | 248/188.5 |
| 4,645,081 | A | 2/1987 | Korth | |
| 4,867,406 | A | 9/1989 | Lengacher | |
| 4,948,149 | A | 8/1990 | Lin et al. | |
| 5,011,104 | A | 4/1991 | Fang | |
| 5,011,174 | A * | 4/1991 | Ross-Clunis | 248/161 |
| 5,468,028 | A | 11/1995 | Olson | |
| 5,474,403 | A | 12/1995 | Hetrich | |
| 5,513,825 | A | 5/1996 | Gutgsell | |
| 5,673,945 | A | 10/1997 | Olson | |
| 5,681,061 | A | 10/1997 | Olson | |
| 5,782,532 | A | 7/1998 | Opsvik | |
| 5,984,567 | A | 11/1999 | Gollin et al. | |

(Continued)

FOREIGN PATENT DOCUMENTS

| | | |
|---|---|---|
| CA | 2149956 C | 12/1998 |
| CA | 2173958 C | 2/2002 |

(Continued)

*Primary Examiner* — Jose V Chen
(74) *Attorney, Agent, or Firm* — Shook, Hardy & Bacon, L.L.P.

(57) ABSTRACT

A mechanism for vertically adjusting a component on a shaft has a collet sleeve riding on the shaft. A spiral track of the component's hub receives a radially outwardly projecting pin on the collet sleeve. The outer surface of the collet sleeve and the inner surface of the hub are tapered so that the hub can rotated one direction to advance the hub on the collet sleeve and compress the collet sleeve onto the shaft to frictionally lock the collet sleeve to the shaft. Because the hub is joined to the collet sleeve by the pin, this also locks the vertical position of the component. Conversely, the hub can be oppositely rotated to release the compression of the collet sleeve so that the collet sleeve, and therefore the vertical component, is slidable on the shaft.

20 Claims, 8 Drawing Sheets

(56) References Cited

U.S. PATENT DOCUMENTS

| | | | | |
|---|---|---|---|---|
| 5,988,754 | A | 11/1999 | Lamart et al. | |
| 6,003,944 | A | 12/1999 | Glockl | |
| 6,138,973 | A * | 10/2000 | Woodward | 248/188.5 |
| 6,478,270 | B2 | 11/2002 | Parisi et al. | |
| 6,520,192 | B1 | 2/2003 | Lo | |
| 6,695,407 | B1 | 2/2004 | Lin | |
| 6,702,504 | B2 | 3/2004 | Fries | |
| 6,749,233 | B2 | 6/2004 | Ohya | |
| 6,862,776 | B2 | 3/2005 | Chen | |
| 6,886,788 | B1 * | 5/2005 | Chung | 248/176.2 |
| 7,118,136 | B2 | 10/2006 | Ohya | |
| 7,229,054 | B2 | 6/2007 | Hu | |
| 7,306,192 | B2 | 12/2007 | Sopp | |
| 7,387,343 | B1 | 6/2008 | Hsieh | |
| 7,425,010 | B2 | 9/2008 | Harris | |
| 8,066,247 | B2 * | 11/2011 | Spera | 248/407 |
| 8,291,840 | B2 * | 10/2012 | Baracchia | 108/147.19 |
| 8,297,563 | B2 | 10/2012 | Tsai | |
| 8,506,200 | B2 * | 8/2013 | Lu | 403/109.2 |
| 2009/0145056 | A1 | 6/2009 | Pereira | |
| 2011/0226925 | A1 | 9/2011 | Tsai | |

FOREIGN PATENT DOCUMENTS

| | | | |
|---|---|---|---|
| CA | 2184405 | C | 3/2002 |
| CA | 2382906 | C | 10/2007 |
| CA | 2165634 | C | 12/2007 |
| CA | 2522422 | C | 12/2008 |

* cited by examiner

HEIGHT ADJUSTMENT MECHANISM SUITABLE FOR A FOOTRING

BACKGROUND

This invention relates to a mechanism for adjusting the vertical height of a component, such as the vertical height of a footring of a seat.

A variety of footring adjustment mechanisms are known. For example, U.S. Pat. No. 6,695,407 issued Feb. 24, 2004 to Lin discloses a footring with a cam attached to the hub of the footring that may be rotated to selectively lock the footring on its supporting shaft. U.S. Pat. No. 8,297,563 issued Oct. 30, 2012 to Tsai discloses a footring with a threaded hub that threads to an externally threaded collet sleeve to selectively lock the footring on its supporting shaft.

Another height adjustment mechanism suitable for use with a footring would be advantageous.

SUMMARY

When assembled, a mechanism for vertically adjusting a component on a shaft has a collet sleeve riding on the shaft. The collet sleeve has one of a radially outwardly projecting pin and a track and the hub of the component has the other of the pin and the track. The track receives the pin and has a first pin stop axially spaced from a second pin stop. Either or both of the outer surface of the collet sleeve and the inner surface of the hub are tapered such that when the hub is moved so that relative movement between the pin and track moves the pin to the first pin stop, the hub is advanced on the collet sleeve to compress the collet sleeve onto the shaft to frictionally lock the collet sleeve to the shaft. Because the hub is joined to the collet sleeve by the pin, this also locks the vertical position of the component. Conversely, when the hub is moved so that relative movement between the pin and track moves the pin to the second stop, the hub is retracted on the collet sleeve to release compression of the collet sleeve so that the collet sleeve is slidable on the shaft and the position of the vertical component on the shaft can be adjusted.

In an aspect, there is provided a mechanism for vertically adjusting a component on a shaft, said component having a hub receiving said shaft, said mechanism comprising: a collet sleeve for riding on said shaft, said collet sleeve having one of a radially outwardly projecting pin and a track; a hub sleeve for attachment to a hub of said component, said hub sleeve having another of said pin and said track; said track for receiving said pin, said track having a first pin stop and a second pin stop, said second pin stop axially spaced from said first pin stop; at least one of an outer surface of said collet sleeve and an inner surface of said hub sleeve tapered such that when said hub sleeve is moved so that relative movement between said pin and track moves said pin to said first pin stop, said hub sleeve is advanced on said collet sleeve to compress said collet sleeve onto said shaft to frictionally lock said collet sleeve to said shaft and when said hub sleeve is moved so that relative movement between said pin and track moves said pin to said second stop, said hub sleeve is retracted on said collet sleeve to release compression of said collet sleeve so that said collet sleeve is slidable on said shaft.

In another aspect, there is provided a footring adjustment mechanism comprising: a collet sleeve for riding on an upright shaft, said collet sleeve having a radially outwardly projecting pin; a hub sleeve for attachment to a hub of said footring, said hub sleeve having a track for receiving said pin, said track having a spiral track section extending between a first pin stop and a second pin stop so that said first pin stop is above said second pin stop; at least one of an outer surface of said collet sleeve and an inner surface of said hub sleeve tapered such that when said hub sleeve is rotated so that relative movement between said pin and track moves said pin along said spiral track section to said first pin stop, said hub sleeve is advanced downwardly on said collet sleeve to compress said collet sleeve onto said shaft to frictionally lock said collet sleeve to said shaft and when said hub sleeve is rotated so that relative movement between said pin and track moves said pin along said spiral track section to said second stop, said hub sleeve is retracted upwardly on said collet sleeve to release compression of said collet sleeve so that said collet sleeve is slidable on said shaft.

In a further aspect, there is provided a seat having an adjustable footring comprising: a support shaft; a collet sleeve riding on said support shaft, said collet sleeve having a radially outwardly projecting pin; a hub of said footring extending about said collet sleeve, said hub having a track receiving said pin, said track having a spiral track section extending between a first pin stop and a second pin stop so that said first pin stop is above said second pin stop; at least one of an outer surface of said collet sleeve and an inner surface of said hub sleeve tapered such that when said hub sleeve is rotated so that said spiral section of said track moves along said pin to said first pin stop, said hub sleeve is advanced downwardly on said collet sleeve to compress said collet sleeve onto said shaft to frictionally lock said collet sleeve to said shaft and when said hub sleeve is rotated so that said spiral section of said track moves along said pin to said second pin stop, said hub sleeve is retracted upwardly on said collet sleeve to release compression of said collet sleeve so that said collet sleeve is slidable on said shaft.

Other features and advantages will become apparent from the following description in conjunction with the drawings.

BRIEF DESCRIPTION OF THE DRAWINGS

In the figures which illustrate example embodiments of the invention.

DETAILED DESCRIPTION

Figure 1:
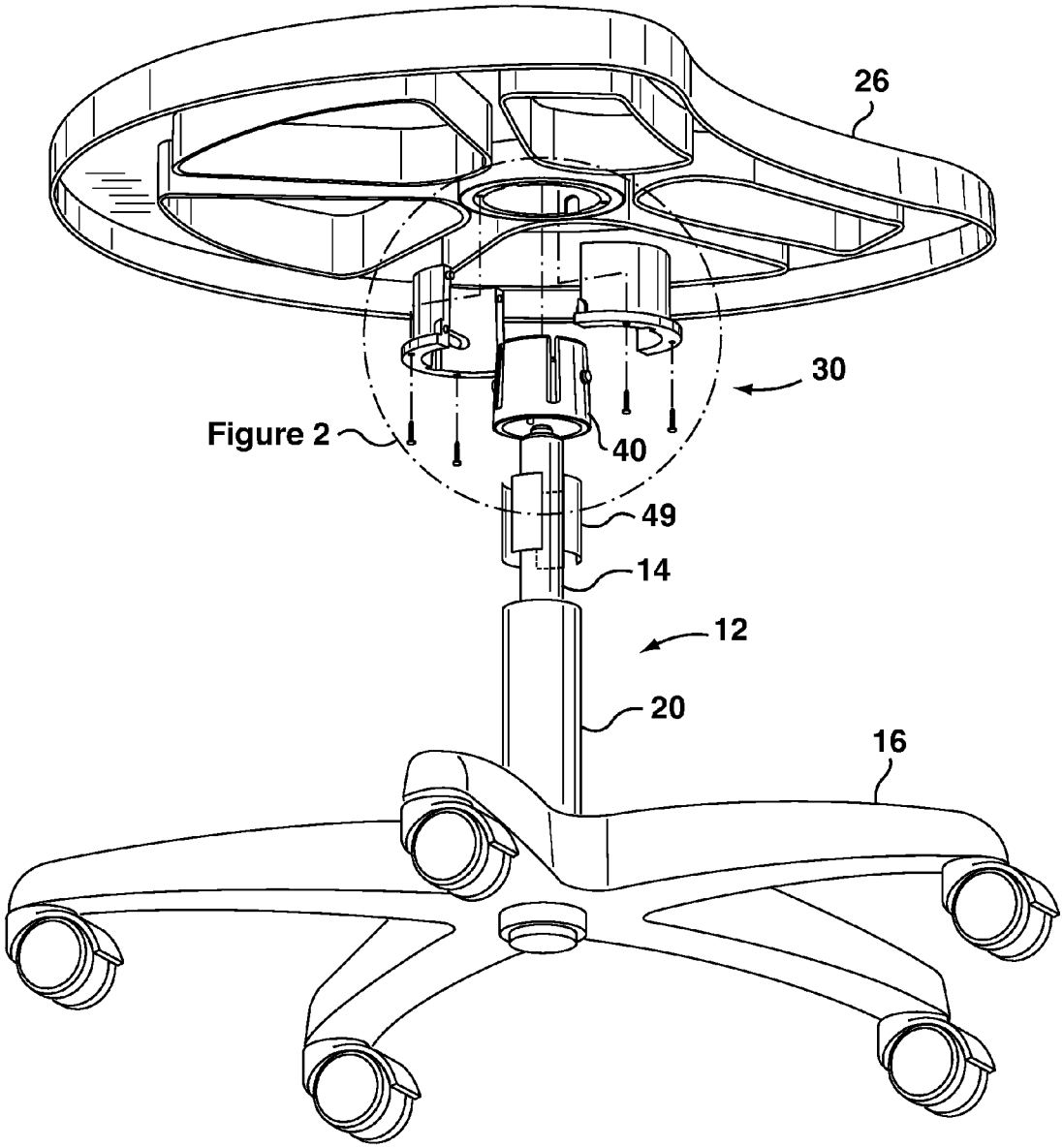
FIG. 1 is an exploded perspective view of a portion of a chair with a height adjustment mechanism for a footring in accordance with an embodiment.

Referencing FIGS. 1 to 4, a chair 10 (FIG. 3) has a gas control cylinder 12 with a cylinder body acting as a support shaft 20. The support shaft 20 is mounted in a wheeled base 16 and the piston shaft 14 of the gas control cylinder supports a chair control mechanism 22 (FIG. 3) to which the seat 24 (FIG. 3) of the chair is attached. The chair has footring 26 supported on the shaft 20 by height adjustment mechanism 30. The height adjustment mechanism 30 has a collet sleeve 40 and a hub sleeve 50.

Figure 4:
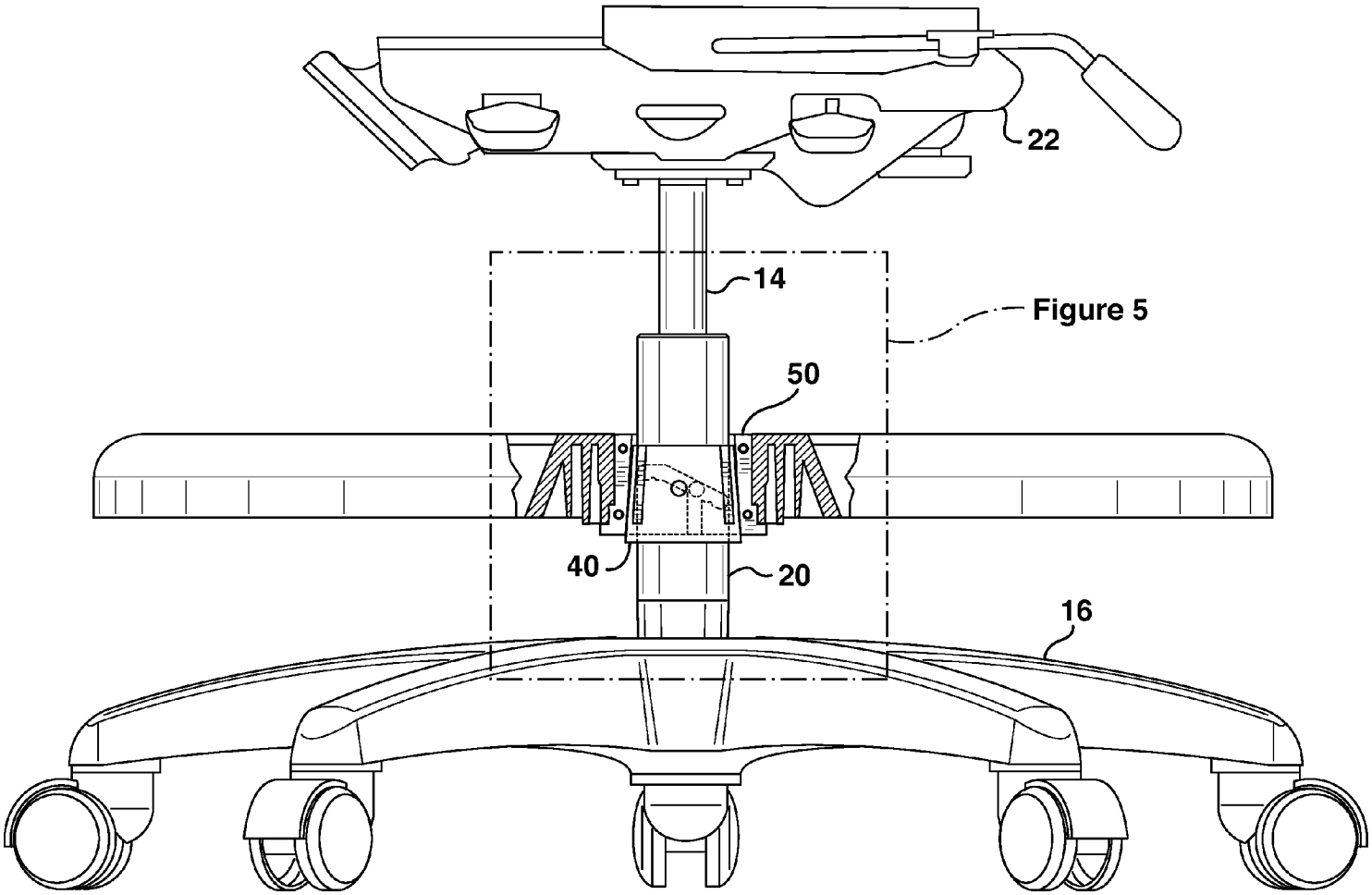
FIG. 4 is a partially sectioned side view of the chair portion of FIG. 3 shown in an assembled state.

With reference to FIGS. 6A to 6D, the collet sleeve 40 is a resilient plastic ring with a series of axially directed slots 42 extending from the upper edge 44 of the ring and a pair of opposed, radially outwardly directed, pins 46. The ring tapers from its base 43 to its upper edge 44. The sleeve has a rectangular depression 48 between each pair of slots. A resilient pad 49 (FIG. 3) is received by each rectangular depression 48 and may be glued in place. As indicated by FIG. 4, the collet sleeve 40 with resilient friction enhancing pads 49 rides on shaft 20.

Figure 2:
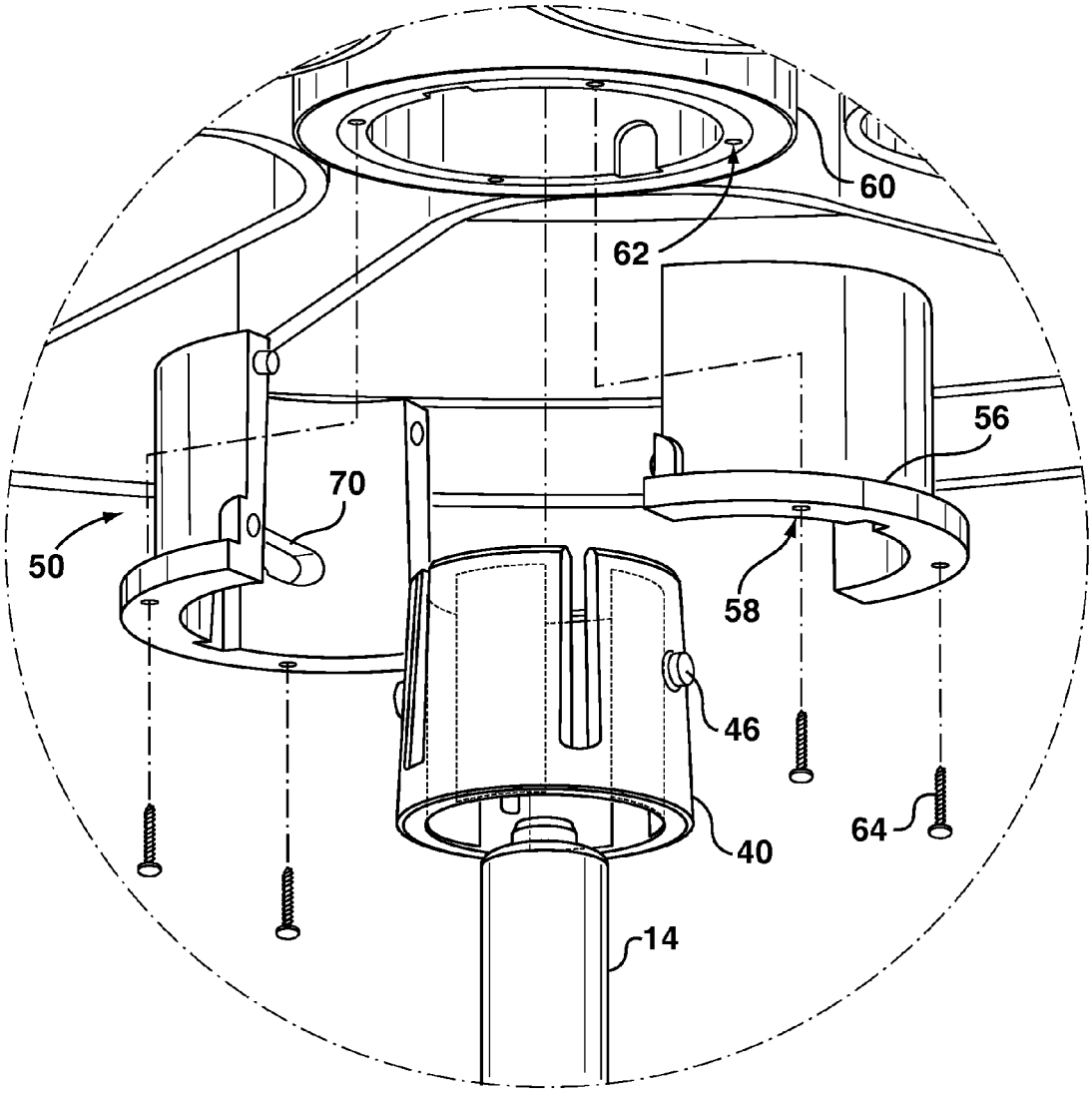
FIG. 2 is a magnified view of the area designated FIG. 2 in FIG. 1.
Figure 3:
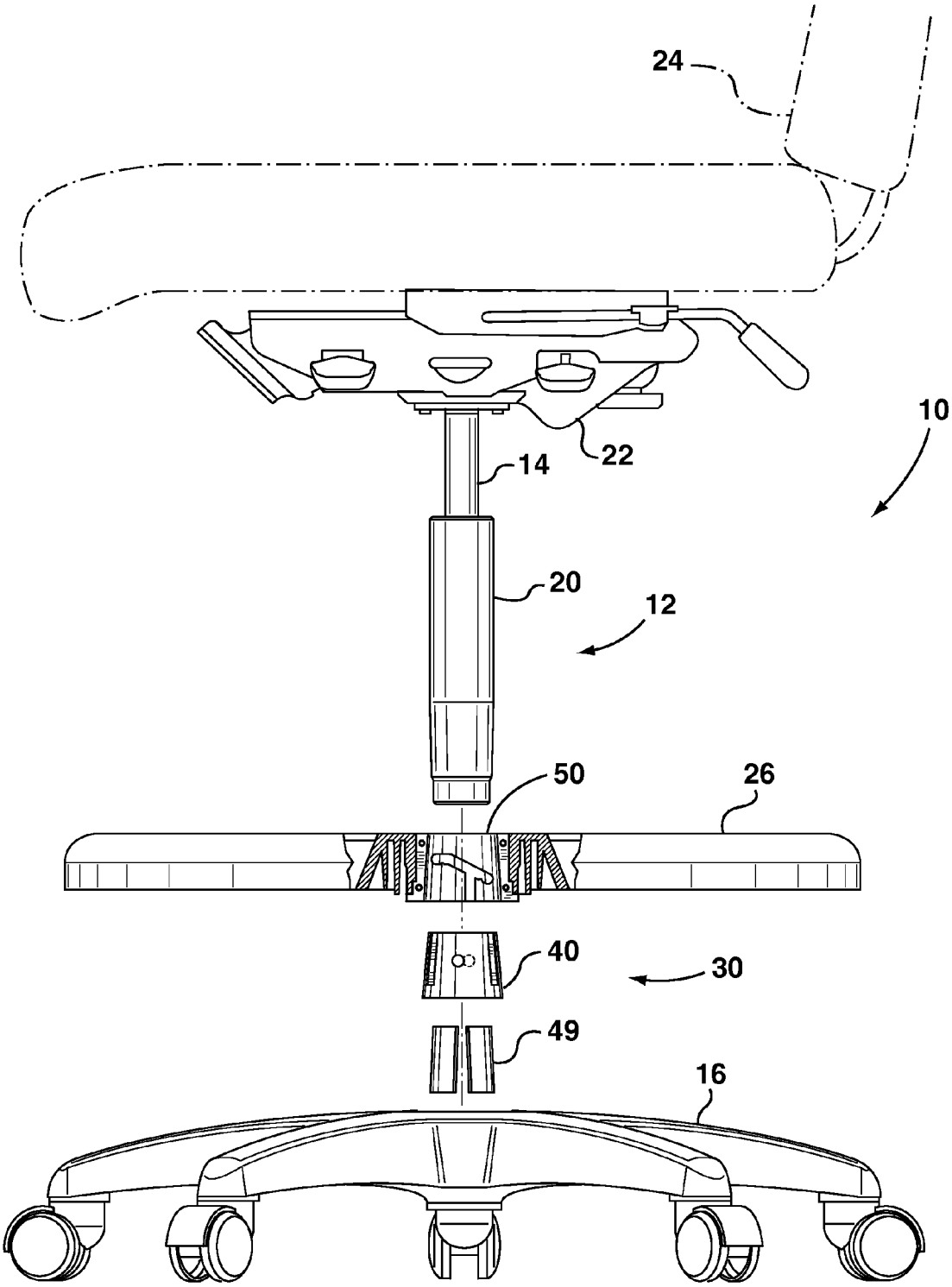
FIG. 3 is an exploded, and partially cross-sectioned, side view of a portion of a chair with a height adjustment mechanism for a footring in accordance with the embodiment of FIG. 1.

With reference to FIGS. 7A to 7D and 8A to 8C along with FIG. 2, the hub sleeve is a pair of hub halves 50*a*, 50*b* with pegs 52 and holes 54 which allow the halves to be mated. The hub sleeve has a basal annular ridge 56 with holes 58 that align with holes 62 in the hub 60 of the footring 26 to allow screws 64 to affix the hub sleeve 50 into the hub of the footring. Each hub sleeve half has a track 70 formed in it for receiving one of the pins 46 of the collet sleeve. The inner surface 67 of the hub sleeve 50 tapers from its base 66 to its upper edge 68. With specific reference to FIG. 7C, track 70 has a spiral track section 72, a first, upper, end portion 74 which extends circumferentially at a constant axial position from the upper end of the spiral track section, and a second, lower, end portion 76 which extends from the lower end of the spiral track section. The first end portion terminates at a first pin stop 80 and defines a detent 82 spaced from the first pin stop. The second end portion terminates at a second pin stop 84 and defines a detent 86 spaced from the second pin stop. The track also has an axially directed track section 88 extending to the spiral track section 72.

In assembly of the chair, the gas control cylinder 12 is inserted into the base 16 and the collet sleeve 40 with attached pads 48 is slid over shaft 20 of the gas control cylinder so that the slots 42 are upwardly directed. The hub sleeve halves 50*a*, 50*b* are mated to form the hub sleeve and the hub sleeve is affixed to the hub 60 of the footring with screws 64. Next the footring with the attached hub sleeve is slid onto the shaft 20 which the axially directed track sections 88 aligned with the pins 46 of the collet sleeve 40 so that the pins slide along the axially directed track sections 88 to the spiral track sections 72, as shown in FIG. 4. Now a chair control mechanism 22 can be installed on the shaft 20 and a seat attached to the chair control mechanism to complete the chair.

Figure 9B:
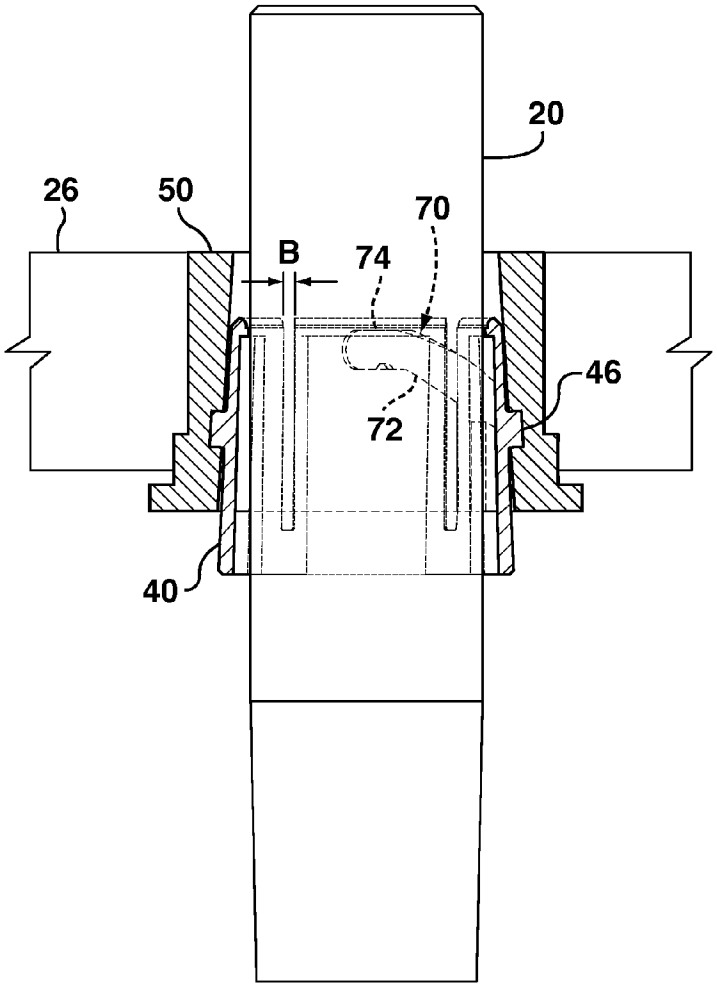
FIGS. 9A and 9B are schematic views showing operation of the height adjustment mechanism.
Figure 9A:
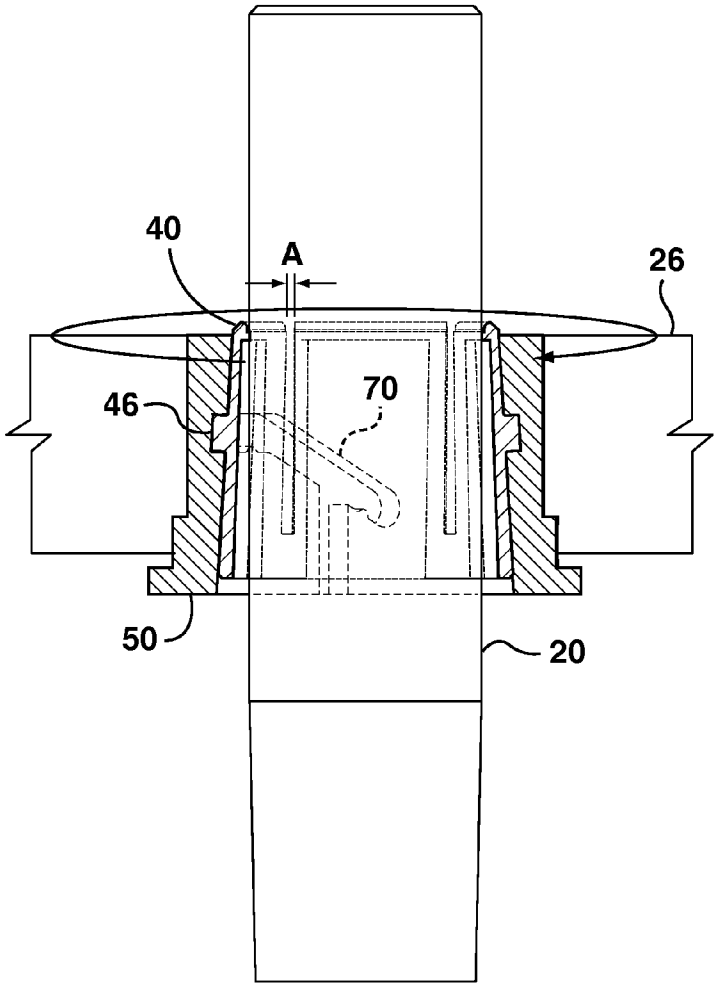

In operation, if the footring 26 and hub sleeve 50 are in the position illustrated in FIG. 9A, the hub sleeve tracks 70 are oriented so that a pin 46 of the collet sleeve is at the first pin stop 80 of each track and the hub sleeve is positioned low over the collet sleeve. In this position, due to the taper of the collet sleeve and inner surface of the hub sleeve, the hub sleeve compresses the collet sleeve so that its slots 42 have a reduced width, as shown at A in FIG. 9A. When in this compressed state, the collet sleeve, aided by the friction enhancing pads 49, is firmly frictionally locked to shaft 20. And because of the pin to track connection between the collet sleeve and the hub sleeve, this means the vertical height of the footring 26 is fixed.

Figure 5:
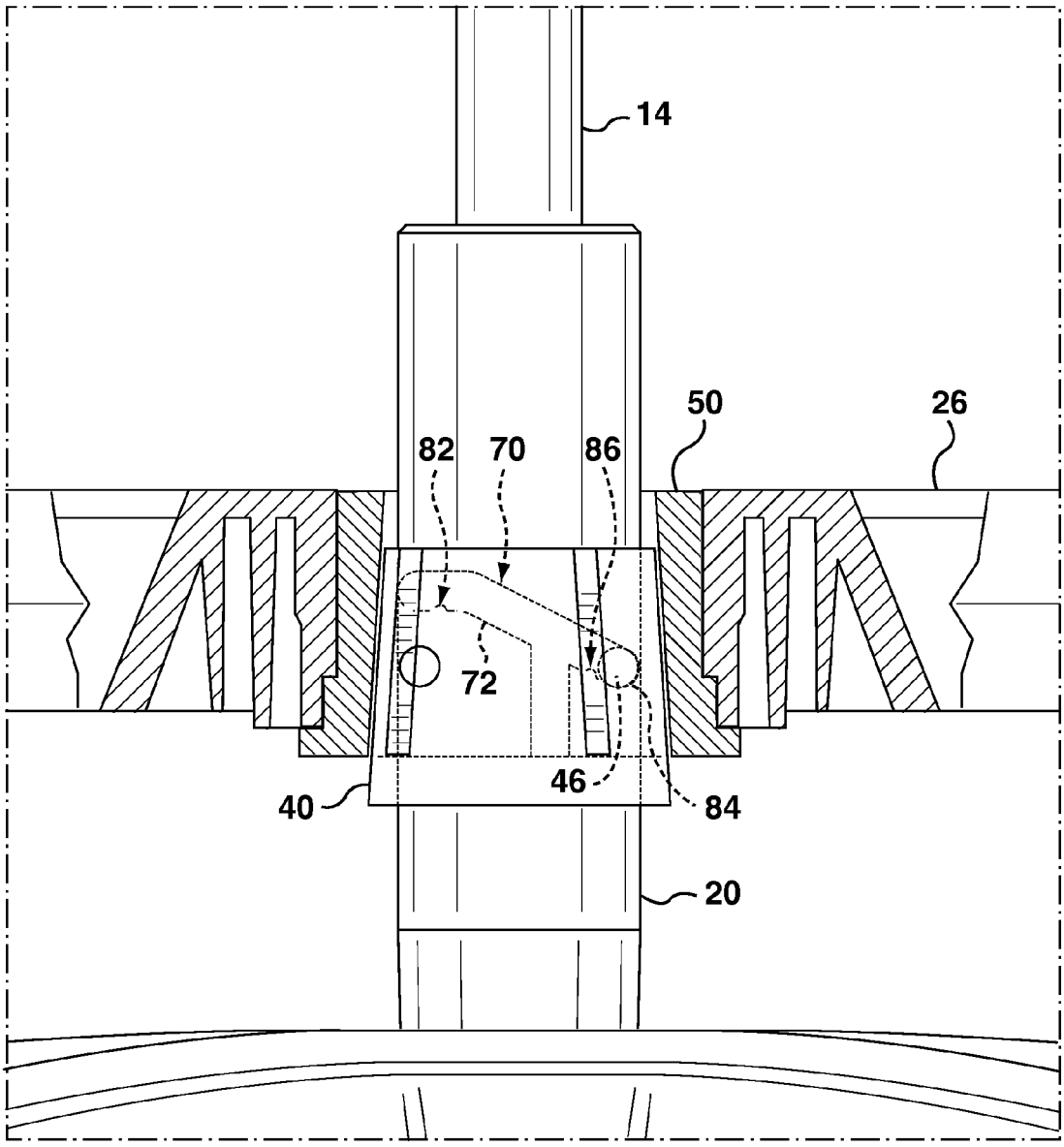
FIG. 5 is a magnified view of the area designated FIG. 5 in FIG. 4 and also illustrates an alternate embodiment.
Figure 6A:
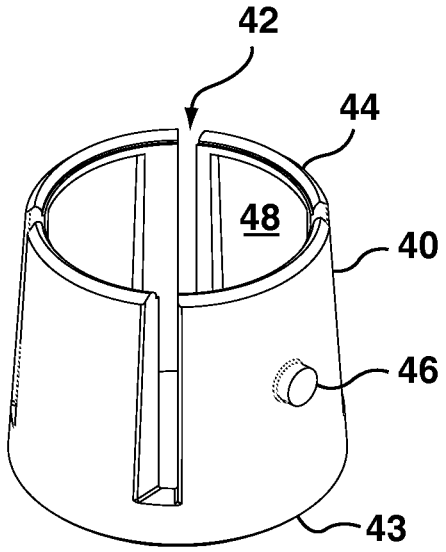
FIG. 6A is a perspective view of the collet sleeve.
Figure 6C:
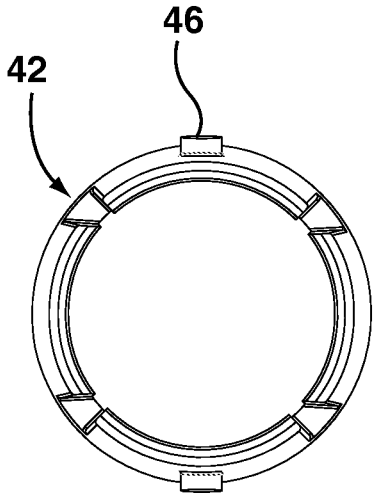
FIG. 6C is a top view of the collet sleeve.
Figure 6B:
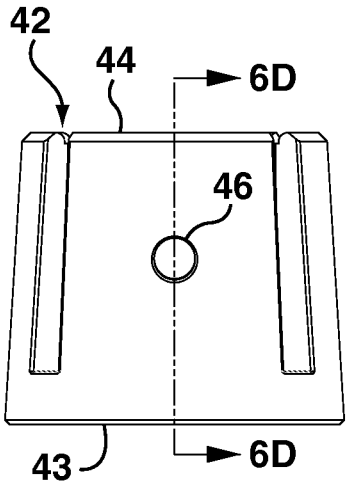
FIG. 6B is a side view of the collet sleeve.
Figure 6D:
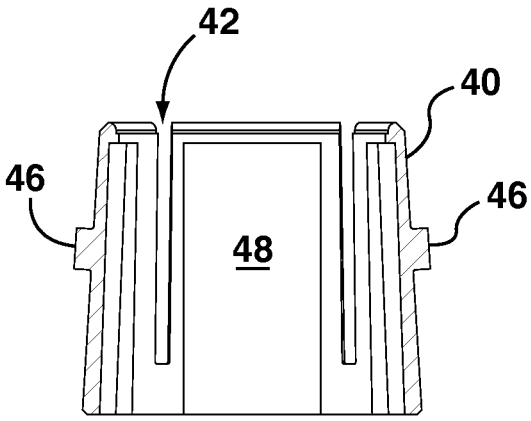
FIG. 6D is a cross-sectional view of the collet sleeve along the lines 7D-7D of FIG. 7B.
Figure 7A:
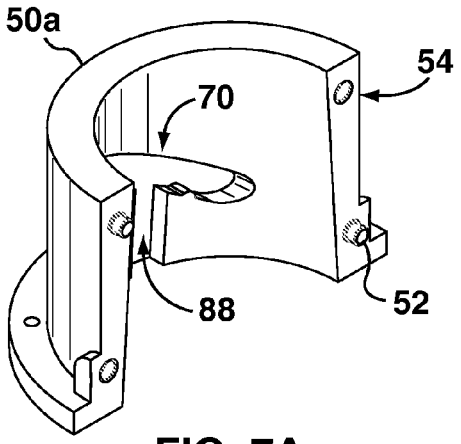
FIG. 7A is a perspective view of a hub sleeve half.
Figure 7B:
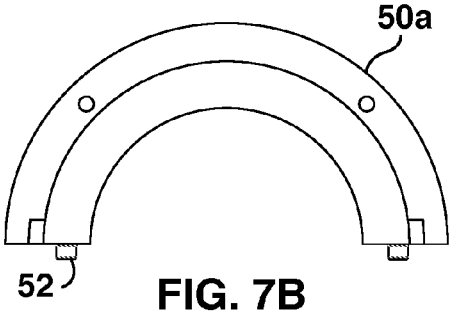
FIG. 7B is a side view of FIG. 7A.
Figure 7C:
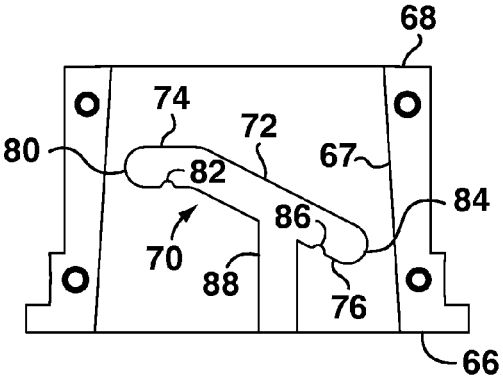
FIG. 7C is a top view of FIG. 7A.
Figure 7D:
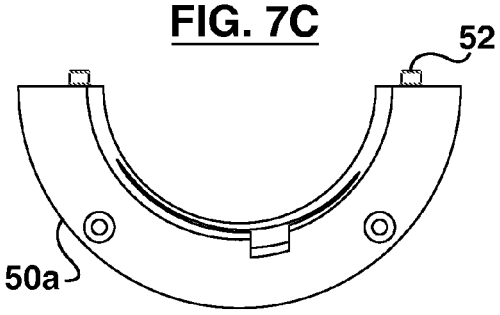
FIG. 7D is a bottom view of FIG. 7A.
Figure 8A:
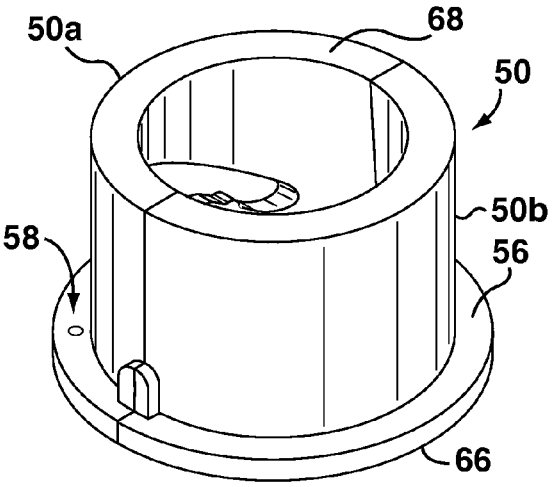
FIG. 8A is a perspective view of an assembled hub sleeve.
Figure 8B:
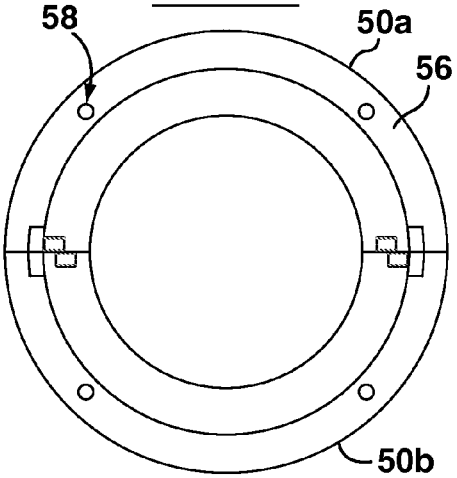
FIG. 8B is a top view of FIG. 8A.
Figure 8C:
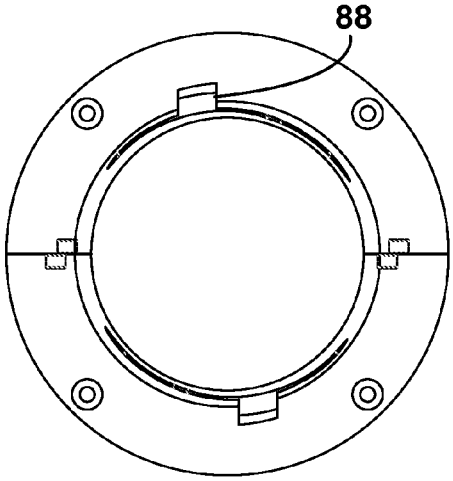
FIG. 8C is a bottom view of FIG. 8A.

From the position illustrated in FIG. 9A, the footring 26 may be rotated in a counterclockwise direction with sufficient force to overcome the track detents 82 to rotate the hub sleeve 50, and hence the tracks 70 of the hub sleeve, counterclockwise. This causes the footring to move upwardly relative to the collet sleeve as the spiral section 72 of each track rides along the pins 46 of the collet sleeve 40 until the pin stops 84 of the tracks abut the pins 46, as illustrated in FIGS. 5 and 9B. In this position, the detent 86 of each track assists in retaining the pins 46 so that the footrest is restrained from rotating clockwise. Because of the taper of the collet sleeve and the inner surface of the hub sleeve, when the hub sleeve is withdrawn upwardly relative to the collet sleeve, the collet sleeve is uncompressed and the slots 42 of the collet sleeve return to their relaxed width, B. With the collet in a relaxed state, it is no longer tightly frictionally locked to the shaft 20. Consequently, a user, by applying an upward or downward force on the footring, can adjust the position of the footring on shaft 20. Once the footring has been adjusted to a desired position, the footring can be rotated clockwise. This moves the tracks along the pins, advancing the hub sleeve on the collet sleeve to compress the collet sleeve as the spiral section of the tracks move along the pins. Once the tracks move so that the pins enter the upper end portion 74 of the tracks 70, continued clockwise rotation will no longer advance the hub sleeve on the collet sleeve but will return the hub sleeve to the position illustrated in FIG. 9A whereat the pin stops 80 of the tracks abut the pins 46 and the collet sleeve and hub sleeve with footring are locked in their new vertical position.

While the track has been described as being formed in the hub sleeve 50 and the pins 46 as projecting from the collet sleeve 40, equally the track could be formed in the collet sleeve and the pins on the hub sleeve. FIG. 5 can be viewed as also showing this embodiment. Also, while the hub sleeve is described as a separate part that is joined to the hub of the footring, a footring could instead be formed with a hub having a track such that a separate hub sleeve is not needed.

While the vertical adjustment mechanism has been described for a footring of a chair, equally the mechanism could be used for a footring of a stool or, indeed, for any other component riding on a shaft.

Other modifications will be apparent to those skilled in the art and, therefore, the invention is defined in the claims.

What is claimed is:

1. A mechanism for vertically adjusting a component on a shaft having an axis, said component having a hub receiving said shaft, said mechanism comprising:

a collet sleeve for riding on said shaft, said collet sleeve having one of a radially projecting pin and a track;

a hub sleeve for attachment to said hub of said component, said hub sleeve having another of said pin and said track, said hub sleeve for riding on said collet sleeve;

said track receiving said pin when said hub sleeve rides on said collet sleeve, said track having a first pin stop and a second pin stop, said second pin stop axially spaced from said first pin stop such that movement of said hub sleeve in one axial direction results in relative movement between said pin and track to move said pin to said first pin stop and movement of said hub sleeve in an axial direction opposite to said one axial direction results in relative movement between said pin and track to move said pin to said second pin stop;

at least one of an outer surface of said collet sleeve and an inner surface of said hub sleeve tapered such that when said hub sleeve is moved so that relative movement between said pin and track moves said pin to said first pin stop, said hub sleeve is advanced on said collet sleeve to compress said collet sleeve onto said shaft to frictionally lock said collet sleeve to said shaft and when said hub sleeve is moved so that relative movement between said pin and track moves said pin to said second stop, said hub sleeve is retracted on said collet sleeve to release compression of said collet sleeve so that said collet sleeve is slidable on said shaft.

2. The mechanism of claim 1 wherein said track has a first spiral track section.

3. The mechanism of claim 2 wherein said track has a first end portion extending circumferentially at a constant axial position from a first end of said first track section, said first end portion terminating at said first pin stop.

4. The mechanism of claim 3 wherein said first end portion defines a detent spaced from said first pin stop.

5. The mechanism of claim 4 wherein said track has a second end portion extending from a second end of said first track section, said second end portion terminating at said second pin stop.

6. The mechanism of claim 5 wherein said second end portion defines a detent spaced from said second pin stop.

7. The mechanism of claim 2 wherein said track has a second track section extending axially to said first track section for permitting admission of said pin to said first track section during assembly.

8. The mechanism of claim 7 further comprising a plurality of resilient pads lining an interior surface of said collet sleeve.

9. The mechanism of claim 2 wherein said hub sleeve comprises two separate sleeve halves.

10. The mechanism of claim 2 wherein said pin extends from said collett sleeve and said hub sleeve has said track.

11. The mechanism of claim 1 wherein said collet sleeve is a resilient plastic ring with a plurality of axial slots extending from one end.

12. A footring adjustment mechanism comprising:

a collet sleeve for riding on an upright shaft, said collet sleeve having a radially outwardly projecting pin;

a hub sleeve for attachment to a hub of said footring, said hub sleeve having a track for receiving said pin, said hub sleeve for riding on said collet sleeve:

said track receiving said pin when said hub sleeve rides on said collet sleeve:

said track having a spiral track section extending between a first pin stop and a second pin stop so that, with said collet sleeve riding on said upright shaft and said hub sleeve riding on said collet sleeve, said first pin stop is above said second pin stop such that downward spiral movement of said hub sleeve results in relative movement between said pin and track to move said pin to said first pin stop and upward spiral movement of said hub sleeve results in relative movement between said pin and track to move said pin to said second pin stop;

at least one of an outer surface of said collet sleeve and an inner surface of said hub sleeve tapered such that when said hub sleeve is moved so that relative movement between said pin and track moves said pin along said spiral track section to said first pin stop, said hub sleeve is advanced downwardly on said collet sleeve to compress said collet sleeve onto said shaft to frictionally lock said collet sleeve to said shaft and when said hub sleeve is moved so that relative movement between said pin and track moves said pin along said spiral track section to said second stop, said hub sleeve is retracted upwardly on said collet sleeve to release compression of said collet sleeve so that said collet sleeve is slidable on said shaft.

13. The mechanism of claim 12 wherein said collet sleeve is a plastic ring with a plurality of axial slots extending from an upper end of said collet sleeve.

14. The mechanism of claim 12 wherein said track has an upper end portion extending circumferentially at a constant axial position from an upper end of said spiral track section, said upper end portion terminating at said first pin stop.

15. The mechanism of claim 12 wherein said track has an axially directed track section extending axially to said spiral track section for permitting admission of said pin to said spiral track section during assembly.

16. The mechanism of claim 12 wherein said hub sleeve comprises two separate sleeve halves.

17. A seat having an adjustable footring comprising:

a support shaft;

a collet sleeve riding on said support shaft, said collet sleeve having a radially outwardly projecting pin;

a hub of said footring extending about said collet sleeve, said hub having a track receiving said pin, said track having a spiral track section extending between a first pin stop and a second pin stop so that said first pin stop is above said second pin stop;

at least one of an outer surface of said collet sleeve and an inner surface of said hub sleeve tapered such that when said hub sleeve is rotated so that said spiral section of said track moves along said pin to said first pin stop, said hub sleeve is advanced downwardly on said collet sleeve to compress said collet sleeve onto said shaft to frictionally lock said collet sleeve to said shaft and when said hub sleeve is rotated so that said spiral section of said track moves along said pin to said second pin stop, said hub sleeve is retracted upwardly on said collet sleeve to release compression of said collet sleeve so that said collet sleeve is slidable on said shaft.

18. The mechanism of claim 17 wherein said collet sleeve is a plastic ring with a plurality of axial slots extending from an upper end of said collet sleeve.

19. The mechanism of claim 18 wherein said track has an upper end portion extending circumferentially at a constant axial position from an upper end of said spiral track section, said upper end portion terminating at said first pin stop.

20. The mechanism of claim 19 wherein said track has an axially directed track section extending axially to said spiral track section for permitting admission of said pin to said spiral track section during assembly.

* * * * *